United States Patent [19]

Ellsberg

[11] 4,430,685

[45] Feb. 7, 1984

[54] VEHICLE LOCK RELEASE MECHANISM OPERABLE WITH A SAFETY INTERLOCK SYSTEM

[76] Inventor: Thomas R. Ellsberg, 6339 Coldwater Canyon, North Hollywood, Calif. 91606

[21] Appl. No.: 866,359

[22] Filed: Jan. 3, 1978

Related U.S. Application Data

[63] Continuation-in-part of Ser. No. 709,314, Jul. 28, 1976, abandoned.

[51] Int. Cl.[3] ..... E05B 65/19

[52] U.S. Cl. ..... 361/172; 70/241; 307/10 AT

[58] Field of Search ..... 361/171, 172; 307/10 AT; 70/240, 241, 254, 279, 283

[56] References Cited

U.S. PATENT DOCUMENTS

| | | | |
|---|---|---|---|
| 3,611,287 | 10/1971 | Hoff et al. | 70/241 X |
| 3,643,479 | 2/1972 | Solow | 70/241 |
| 3,744,285 | 7/1973 | Barmherzig | 70/241 |
| 4,102,164 | 7/1978 | Barbush | 70/241 |

FOREIGN PATENT DOCUMENTS

| | | | |
|---|---|---|---|
| 2116448 | 10/1972 | Fed. Rep. of Germany | 70/241 |

*Primary Examiner*—Harry E. Moose, Jr.

[57] ABSTRACT

A lock release mechanism which is operable in conjunction with a locking device on an access means, such as a hood into a portion of a vehicle, preferably an automotive vehicle. The lock release mechanism comprises an outer housing having a shiftable locking element therein. The shiftable locking element is locked when a shiftable plunger, such as a wedge, is biased into locking position. The lock release mechanism also includes a solenoid which is energized to remove the plunger from the locking position. When the plunger is removed from its locking position, the lock device on the access means can be operated.

The lock release mechanism is preferably designed for use in vehicles of the type equipped with a safety interlock system and which is electrically operable pursuant to the introduction of a preselected code through a plurality of manually operable input switches. In most cases, the safety interlock system comprises a plurality of latches which are operated in preestablished sequence when a preestablished code of indicia is introduced through manual operation of the plurality of input switches. When the latches are operated pursuant to the introduction of the preestablished code, the lock release mechanism may be operated.

35 Claims, 8 Drawing Figures

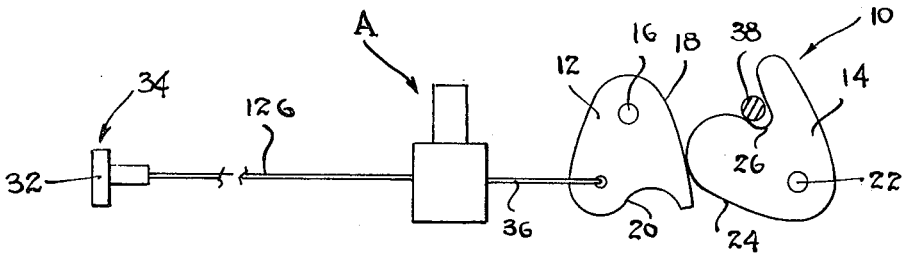
FIG. 1A
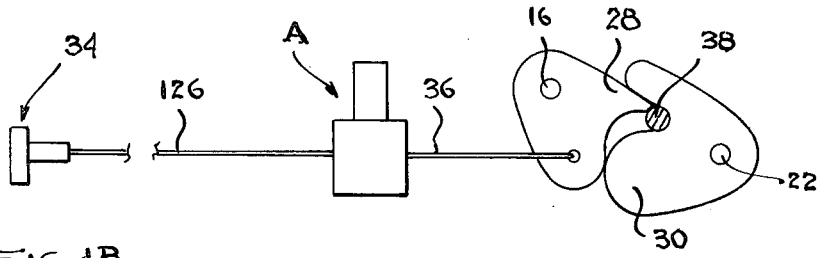
FIG. 1B
FIG. 3
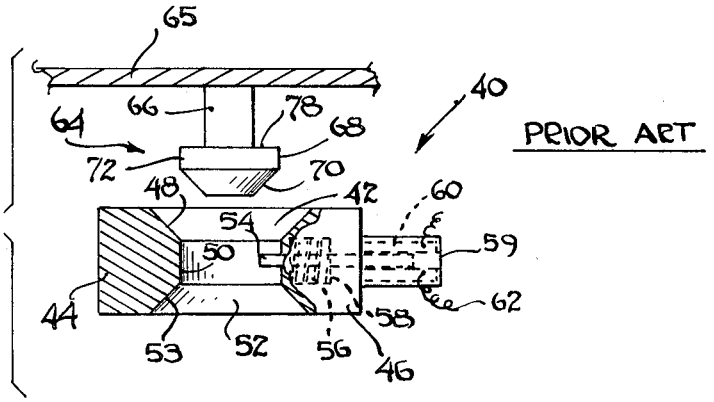
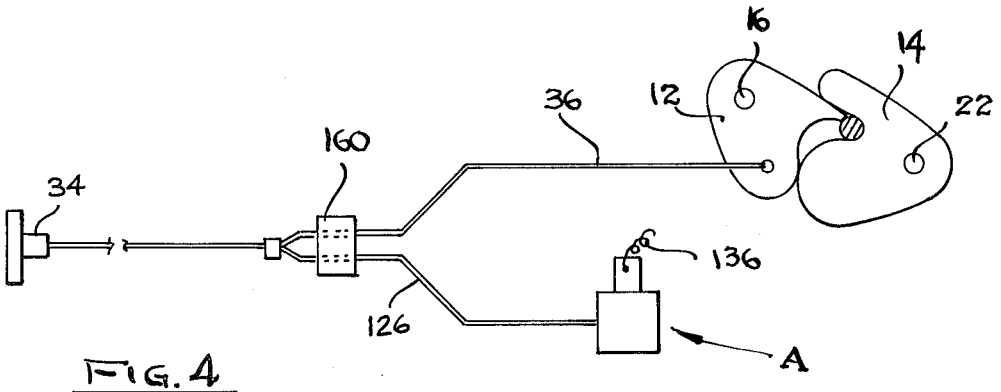
FIG. 4

VEHICLE LOCK RELEASE MECHANISM OPERABLE WITH A SAFETY INTERLOCK SYSTEM

RELATED APPLICATION

This application is a continuation-in-part patent application of U.S. patent application Ser. No. 709,314, filed July 28, 1976, entitled SAFETY INTERLOCK SYSTEM, now abandoned.

BACKGROUND OF THE INVENTION

1. Purpose of the Invention

This invention relates in general to certain new and useful improvements in lock release mechanisms utilizable in vehicles for preventing theft, and, more particularly, to lock release mechanisms which are operated in conjunction with safety interlock systems designed to prevent theft or other unauthorized removal of automotive vehicles and like apparatus.

2. Brief Description of the Prior Art

In recent years, theft of automotive vehicles has become quite prevalent and, in fact, has given rise to large-scale businesses based on stealing and resale of such automotive vehicles. In order to obviate this problem, various manufacturers of automotive vehicles and, in addition, various suppliers of safety systems and theft-prevention systems and the like have proposed alarm systems for use in these vehicles which advise of the potential theft or otherwise unauthorized removal of the vehicle. These alarm systems generally rely upon electronic sound alarms which are generated upon unauthorized attempts of removal. However, one skilled in these particular alarm systems is capable of short-circuiting the alarm system or otherwise removing the vehicle in such manner as to obviate the generation of the alarm signal.

There have been many proposals for safety interlock systems which employ encoded switching systems which must be actuated prior to operation of the vehicle. These encoded switch systems operate as a combination switch which is designed to prevent operation of the engine of the vehicle until such time as a proper electrical signal has been introduced into the switching system in order to energize the same. The signal is an enabling signal which is generated when a plurality of switches has been actuated in proper sequence. These switching systems are designed to control the various operable components of the vehicle and particularly the electrically operable components such as, for example, the starter solenoid of the vehicle. Thus, when the pre-established code is introduced into the system, the starter solenoid is enabled.

One of the primary disadvantages of these safety interlock systems resides in the fact that a typical automotive thief may open the hood of the vehicle in order to disenable the safety interlock system. Otherwise, if the thief is unable to disenable the safety interlock system, the thief can typically obviate or bypass the safety interlock system and thereby steal the vehicle.

Most automotive vehicles presently employ some form of hood lock mechanism such as the hood lock mechanism which may be opened from the exterior of the vehicle. In other types of automotive vehicles, the hood lock can only be opened from the interior of the vehicle, such as in the passenger compartment. In the event that the doors of the vehicle leading into the passenger compartment were not locked, then a thief would have easy access to open the hood lock release and thereby the compartment to disenable any safety interlock system. In addition, the thief may otherwise easily steal any of the components forming part of the engine system of the vehicle or the entire vehicle itself.

There have also been several proposed lock release mechanisms operable with the lock device included with the vehicle. These lock release mechanisms included a lock which operated the locking device of the vehicle on the hood leading into the engine compartment when the engine was started.

The typical type of electrically operable lock release mechanism which operates the hood lock comprises a housing having a pair of spaced apart walls with a locking pin extending out of one of the walls. A wedge or plunger is introduced into the space between these walls and when the pin was retracted, the wedge would be fully inserted into the space and thereby locked when the pin was released to engage an upper surface on the wedge. Thus, when a solenoid was energized pursuant to starting of the ignition of the vehicle, the pin would be retracted and, in this way, the wedge could be removed. Nevertheless, if the solenoid was not properly energized pursuant to the energization of the ignition system of the vehicle, the pin remained in its locking position, thereby permitting removal of the wedge which was, in turn, connected to the hood of the vehicle.

The primary disadvantage of this type of electrically energizable hood release mechanism resided in the fact that it is difficult to align the wedge or plunger with the pin. It can be observed that it is difficult to align the plunger with the pin when the hood was closed primarily due to the fact that the plunger moved through an arc with the closing of the hood. Thus, the mechanics installing the device could not properly align the plunger with the opening between the two walls when the hood was almost in the closed position. The difficulty of aligning the plunger with the opening also was increased due to the fact that it was often difficult to find a proper location in which to install the plunger so that it could be dropped into the opening in proper alignment. Another one of the disadvantages of this type of device is that if the hood was sprung due to an automobile accident or other condition, the hood could not be closed, and if one attempted to close the hood when the plunger was not in proper alignment, it would tend to jam the entire device and even result in damage to the lock release mechanism.

Due to the difficulties of properly installing these prior art lock release mechanisms, it has been found that the hood lock release device cannot be properly opened if the hood lock release mechanism is not properly mounted.

OBJECTS OF THE INVENTION

It is, therefore, the primary object of the present invention to provide a lock release mechanism which is used with a lock device for use in powered vehicles and the like, and which permits releasing of the lock release mechanism by introduction of an electrical signal which operates the hood lock release mechanism.

It is another object of the present invention to provide a hood lock release mechanism of the type stated which is easily installed and does not require precise alignment of a plunger with respect to the lock mechanism.

It is a further object of the present invention to provide a hood lock release mechanism of the type stated which operates in conjunction with a safety interlock system such that the hood lock release mechanism can only be operated when a preselected code is introduced in proper sequence through manual actuation of a plurality of input switches.

It is an additional object of the present invention to provide a method of operating a hood lock release mechanism in such manner that the hood lock release mechanism can only permit opening of a hood lock when a proper preselected code is introduced in proper sequence and which thereby obviates unauthorized removal of any device upon which the locking release mechanism is utilized.

It is also an object of the present invention to provide a unique electrical circuit which operates the hood lock release mechanism of the present invention in such manner that only the authorizer users of the vehicle can open the hood of the vehicle leading into the engine compartment.

With the above and other objects in view, my invention resides in the novel features of form, construction, arrangement and combination of parts presently described and pointed out in the claims.

SUMMARY OF THE INVENTION

The invention relates to a system for controlling automotive vehicles and like vehicles and, particularly, for controlling the action of a conventional lock on a vehicle access means as well as the electrical system forming part of the engine of the vehicle. Thus, the invention, in one aspect, includes a circuit for controlling an electrically operable component forming part of the engine system of the vehicle and which also controls a lock release mechanism providing access into a portion of the vehicle.

The system for controlling a lock on the vehicle comprises a safety interlock circuit having a plurality of manually operable switches which generate an enabling signal when certain of the switches have been actuated in a proper sequence in accordance with a preestablished code. The system also comprises a manually actuable lock device on a vehicle access means. In this case, the lock device could form part of a conventional lock on the hood of an automotive vehicle. In addition, the system operates in conjunction with an electrically operable component forming part of the vehicle engine. This electrically operable component is operatively connected to the safety interlock circuit and is operable when the enabling signal has been generated. When the enabling signal has been generated, the lock release mechanism permits opening of the lock device. In addition, the lock release mechanism prevents opening of the lock device when the lock release mechanism is deenergized.

In a preferred aspect of the invention, a sensing means is operatively connected to the interlock circuit for holding the lock release mechanism in a position as it would be when energized even though generation of the enabling signal has ceased. This sensing means holds the lock release mechanism in this position until the access means, such as the hood of the vehicle, is closed. In this way, damage to the lock release mechanism is obviated. Moreover, the access means cannot be opened again until the enabling signal is generated through proper introduction of the preselected code by actuation of the plurality of switches.

The lock release mechanism is also actuable by a manually actuable member, such as a hood lock release member, located in the passenger compartment of the vehicle. This manually actuable member, such as the hood lock release handle, is operatively connected to the lock release mechanism of the present invention and permits the lock release mechanism to open after the lock release mechanism has been energized pursuant to the enabling signal.

The lock release mechanism comprises an outer housing having a first bore and a second bore angularly located with respect to the first bore and, preferably, perpendicularly located with respect to the first bore. A shiftable lock cooperating element is located within the first bore. This lock cooperating element has a pair of spaced apart heads defining a plunger receiving space therebetween, such that the plunger receiving space is capable of being located in alignment with the second bore.

A plunger is located within the second bore and is provided with a locking element capable of being shifted into a locking position in said plunger receiving space in order to prevent movement of the shiftable lock cooperating element. An electrically operable means is associated with the plunger for shifting the plunger out of the plunger receiving space in order to permit movement of the lock cooperating element upon energization of the electrically operable means.

The electrically operable means is preferably a conventional electrical solenoid. The means which biases the plunger is a coil spring which normally biases the plunger into the locking position but can be overcome by energization of the solenoid. Thus, the solenoid should generate sufficient electromagnetic coupling in order to pull the plunger to a position where the locking section is removed from the plunger receiving space. Moreover, the lock cooperating element is normally biased to a position where the plunger receiving space is aligned with the plunger. A compression spring is designed to bias the lock cooperating element to this position. In addition, a cable is normally connected to the lock cooperating element for manually pulling the plunger against the action of the compression spring which biases the plunger into the position where the plunger receiving space is aligned with the plunger. The cable is also operatively connected to the lock device such that pulling on the cable will open the lock device.

BRIEF DESCRIPTION OF THE DRAWINGS

Figure 5:
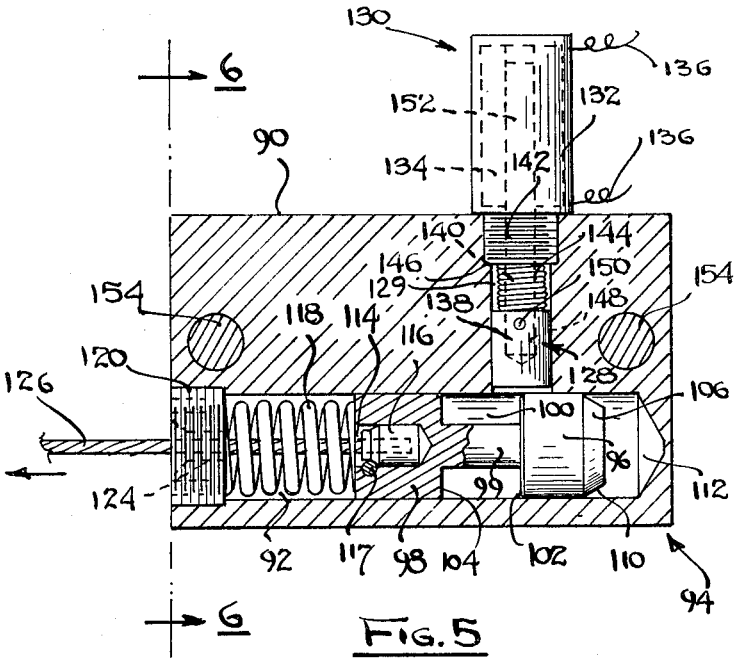
Figure 6:
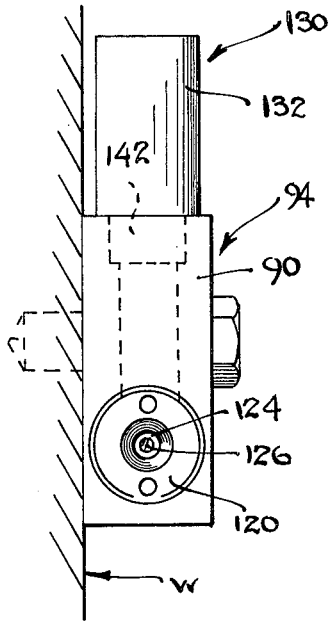
Figure 7:
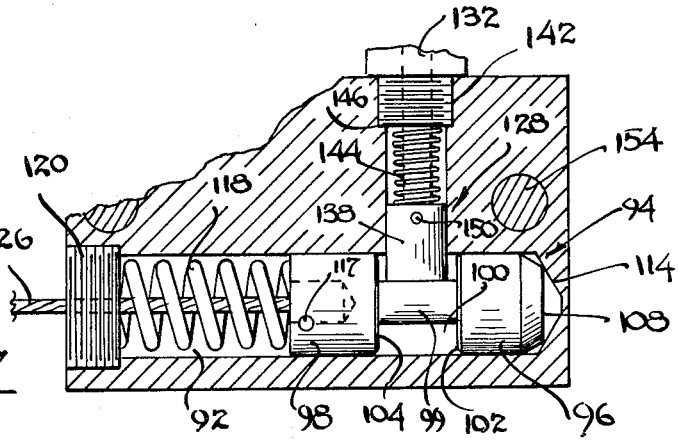
Figure 8:
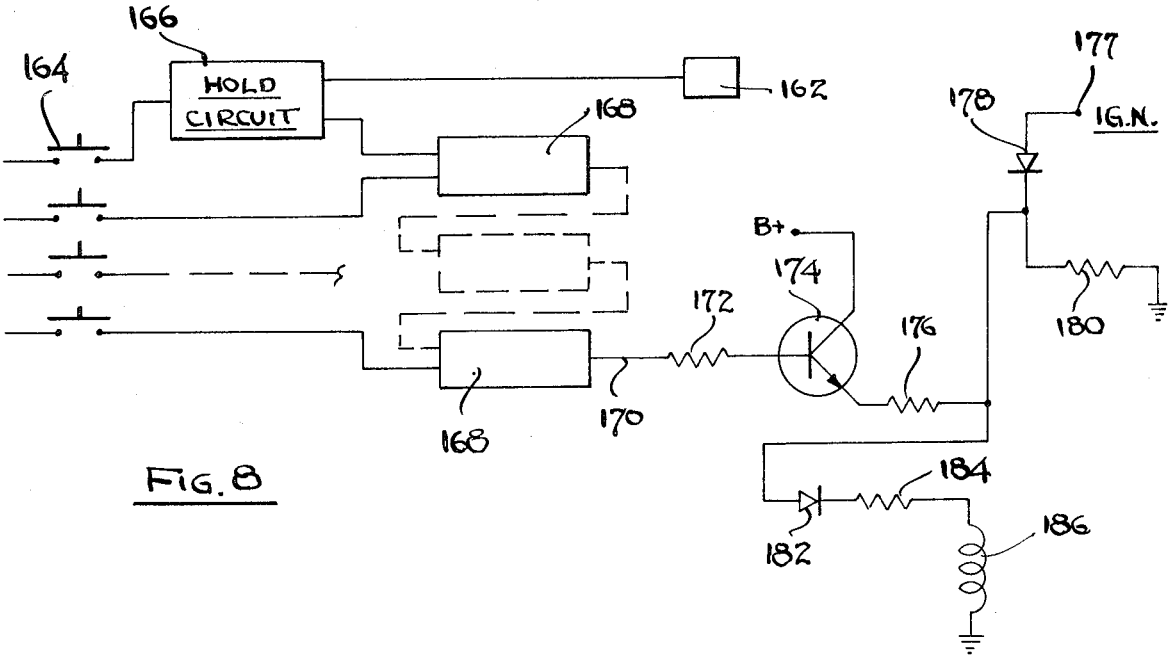

Having thus described the invention in general terms, reference will now be made to the accompanying drawings in which:

FIG. 1 is a side elevational schematic view showing a conventional hood lock mechanism of an automotive vehicle operated in conjunction with the hood lock release mechanism of the present invention when in the opened position;

FIG. 2 is a schematic side elevational view, similar to FIG. 1, and showing a conventional hood lock operated by the hood lock release mechanism of the present invention when in the locked position;

FIG. 3 is a vertical fragmentary sectional view showing a portion of the prior art type of hood lock release mechanism;

FIG. 4 is a schematic side elevational view showing the method of connecting the hood lock release mechanism of the present invention to a hood lock of an automotive vehicle;

FIG. 5 is a vertical sectional view in longitudinal cross section showing the interior components of the hood lock release mechanism of the present invention;

FIG. 6 is an end elevational view of a hood lock release mechanism of the present invention taken along line 6—6 of FIG. 5;

FIG. 7 is a fragmentary vertical sectional view, somewhat similar to FIG. 6, and showing the hood lock release mechanism in the locked position; and FIG. 8 is a schematic electrical view showing a portion of a safety interlock system which is utilized in connection with the hood lock release mechanism of the present invention.

DETAILED DESCRIPTION OF THE PREFERRED EMBODIMENT

Referring now in more detail, and by reference characters to the drawings, A designates a safety lock release mechanism which is constructed in accordance with and embodies the present invention. This lock release mechanism is specifically designed to be utilized in connection with the hood release locks of automotive vehicles and like devices or other forms of locks in other portions of the vehicles.

The lock release mechanism of the present invention is generally designed to be used with safety interlock systems, and, particularly, that form of safety interlock system which is energized by introduction of a preselected code in proper sequence by a plurality of manually operable input switches. However, the lock release mechanism of the present invention can be used with a wide variety of safety interlock systems, but is more specifically adapted to be used with that safety interlock system described in my copending application Ser. No. 709,314, filed July 28, 1976, and in my copending application Ser. No. 866,287, filed contemporaneously herewith, now abandoned in favor of application Ser. No. 7,359 filed Jan. 29, 1979 and which matured into U.S. Pat. No. 4,233,642 dated Nov. 11, 1980.

The lock release mechanism in conjunction with the safety interlock system is specifically designed to prevent theft or other unauthorized removal of automotive vehicles. However, it should be understood that the lock release mechanism and the safety interlock system could be used in a wide variety of applications, including the unauthorized removal of other forms of vehicles, e.g. boats, airplanes and the like. In addition, the lock release mechanism could be used without the safety interlock system, or in addition, to the safety interlock system in order to prevent unauthorized tampering with other devices.

FIG. 1 illustrates a conventional hood lock 10 used in conjunction with the hood lock release mechanism A of the present invention, and, in this case, the conventional hood lock includes a pair of camming plates 12 and 14 which are often referred to as camming "discs". These camming discs cooperate to serve as a lock and are, therefore, often referred to as locking discs. The first camming disc 12 is being shown as pivoted on a pivot pin 16 with a first camming surface 18 and having a recess 20. The second camming disc 14 is pivoted on a pivot pin 22 and includes a camming surface 24 mating with the camming surface 18 and also includes a second recess 26. In the position as illustrated in FIG. 1, the lock mechanism is in the open position, such that the hood or other portion of the vehicle can be opened.

Referring now to FIG. 2, it can be observed that the conventional lock mechanism of the vehicle is in the locked position such that the hood or other portion of the vehicle could not be opened without releasing the same from the interior passenger compartment of the vehicle. In this case, it can be observed that the first and second camming discs 12 and 14, respectively, are rotated to a position such that a first finger 28 on the first camming disc extends into the recess 26 on the second disc 14. In like manner, a second finger 30 on the second camming disc 14 extends into the recess 20 on the first camming disc 12. In this way, the lock mechanism cannot be opened until the same is released through a release mechanism 32 in the passenger compartment of the vehicle.

Referring again to FIGS. 1 and 2, it can be observed that the release mechanism includes a handle 34 which is located in the passenger compartment of the vehicle and connected to the camming disc 12 by means of a cable 36. In the absence of the lock release mechanism A, the handle 34 can be pulled in order to shift the camming plates 12 and 14 from the position as illustrated in FIG. 2 to the position as illustrated in FIG. 1, thereby permitting opening of the hood of the vehicle. More specifically, it can be observed that the hood of the vehicle includes a locking pin 38 which is located in the recess 26 in the locked position, but which can be removed from the recess 26 when the camming discs 12 and 14 are shifted to the opened position as illustrated in FIG. 1 of the drawings. Thus, the lock mechanism as illustrated in FIGS. 1 and 2 can be operated without the lock release mechanism A as illustrated.

However, in the preferred aspect of the present invention, the lock mechanism A is included to prevent the opening of the hood lock 10 by being shifted from the closed position as illustrated in FIG. 2 to the opened position as illustrated in FIG. 1 without introduction of the preselected code as described above and as hereinafter described in more detail. Thus, if the proper preselected code has not been entered, the hood lock release mechanism A would not be energized to permit the shifting of the cam plates 12 and 14 in FIG. 2 to the opened position as illustrated in FIG. 1.

FIG. 3 illustrates a prior art lock release mechanism. These mechanisms were not used in conjunction with a safety interlock system, but merely operated by turning on the ignition of the vehicle. In this case, the prior art lock release mechanism, designated as 40, operates in connection with a conventional hood lock 10 in order to permit opening of the same, such that the camming discs 12 and 14 are shifted to the position as illustrated in FIG. 1 upon energization of the lock release mechanism as herein described. The prior art lock release mechanism 40 is comprised of an outer housing 42 having a pair of spaced apart opposed camming plates 44 and 46 and each of which are provided with opposed, upwardly presented and downwardly and inwardly converging camming surfaces 48. The camming surfaces 48 merge into relatively parallel spaced apart surfaces 50 located on the respective camming plates 44 and 46 and which in combination define a plunger opening 52. The spaced apart, relatively parallel surfaces 50 also merge into diverging, outwardly extending camming surfaces 53.

One of the camming plates 46 is provided with a locking pin 54 which extends toward the camming surface 50 in the manner as illustrated in FIG. 3. The locking pin 54 is normally biased into a locking position as illustrated in FIG. 3 so that it extends into the opening 52 by means of a coil spring 56. The coil spring fits within a recess 58 so as to bias the locking pin 54 to the outward position or locking position as illustrated in FIG. 3 of the drawings. The locking mechanism 40 is also provided with a solenoid 59 which contains a solenoid coil 60 and operable through a pair of conductors 62. When current is introduced into the coil 60, it is energized and thereby magnetically urges the locking pin 54 to the retracted position so that it is removed from the space 52. Deenergization of the coil 60 permits the locking pin 54 to be extended into the locking space 52 by action of the compression spring 56.

A locking plunger 64 operates in conjunction with the lock release mechanism 40 and is mounted on the interior surface of a hood 65, as illustrated in FIG. 3 of the drawings. The plunger 64 is comprised of a shank 66 and an enlarged locking head 68, the latter having camming surfaces 70 which merge into a relatively flat annular wall 72. In this way, the plunger 64 extends downwardly into the opening 52, and the camming faces 70 are capable of biasing the locking pin 54 inwardly against the action of the compression spring 56. After the plunger is shifted to its lowermost or seated position, the locking head will be below the level of the pin 54. In this latter position, the locking pin 54 will be extended outwardly by the action of the compression spring 56 so as to engage a shoulder 74 on the plunger, and thereby secure the hood 65 in a locked position.

This prior art mechanism has been found to be relatively ineffective in that the locking pin 54 must be retracted in the event that the hood 66 is shifted to the closed position. Otherwise, the camming surfaces 70 on the plunger 64 would engage the locking pin 54 and bend the same if force was applied to the hood 65. Even moreso, it was found necessary to properly align the plunger 64 with respect to the opening 52 in order to permit the plunger 64 to extend within the opening 52 even when the locking pin 54 was retracted. Otherwise, the misalignment would result in damage to the lock release mechanism 40 as well as improper operation.

The lock release mechanism A of the present invention is more fully illustrated in FIGS. 5–7 of the drawings. In this case, the lock release mechanism A of the present invention comprises an outer housing 90 which is capable of being located and physically mounted within the engine compartment of the vehicle and which operates in conjunction with the conventional hood lock mechanism 10. It should also be observed that the locking release mechanism A could be mounted in any portion of the vehicle including the trunk portion of the vehicle so as to prevent unauthorized opening of the trunk of the vehicle. In addition, the lock release mechanism A could be located in any other portion of the vehicle in order to prevent unauthorized entry of the vehicle, as for example, with respect to the doors of the vehicle leading into the passenger compartment of the vehicle or other portions of the vehicle.

The housing 90 is internally bored to provide a first horizontally located circular passage 92 in the manner as illustrated in FIG. 6 of the drawings. Shiftably located within the bore 92 is an elongate lock cooperating plug 94 comprised of a pair of spaced apart, locking heads 96 and 98. These two heads 96 and 98 are connected by a central shaft 99 defining an annular plunger receiving space 100 in the manner as illustrated in FIG. 5. Each of the head sections 96 and 98 are provided with a pair of relatively flat end 108, but which is capable of engaging a shoulder 110 on a tapered recess 112. The other head 98 is provided with a recess 114 sized to accommodate a swedge 116 which is used to secure the forward end of a release cable within the bore 92. The swedge 116 is locked in place by means of a transversely extending pin 117 often referred to as a "roll pin".

The plug 94 including the combined heads 96 and 98, along with the shaft 99, is biased toward the right-hand direction in the manner as illustrated in FIG. 5 by means of a compression spring 118 which is interposed between the left-hand end of the head 98 and a retaining plug 120 located at the left-hand end of the bore 92. In this case, it can be observed that the swedge 116 provides a means for securing the end of a cable 126 to permit actuation of the hood lock assembly in the vehicle. The swedge 116 is located coaxially within the bore 92, and the cable extends into a central bore 124 formed in the plug 120 in the manner as illustrated in FIG. 5. In this case, the cable 126 corresponds to a cable leading from the lock release mechanism A to the handle 34 in the manner as illustrated in FIGS. 1 and 2 of the drawings.

The lock release mechanism A also includes a plunger 128 which is operable by a solenoid 130 mounted on the housing 90, in the manner as illustrated in FIG. 5. The plunger 128 is vertically shiftable in a vertical bore 129 communicating with the bore 92. The solenoid 130 includes a conventional solenoid housing 132 along with a solenoid coil 134 located therein in a conventional manner. In this case, the solenoid 130 would be operated by energization of the solenoid coil 134 through a source of electrical current applied to the coil 134, in a manner to be hereinafter described, through conductors 136. The plunger 128 includes a locking head 138 which is capable of being extended into the annular space between the end walls 102 and 104 in the manner as illustrated in FIGS. 5 and 7 of the drawings.

The locking head 138 is connected to a plunger shaft 140 which extends through a sleeve 142 which is integral with the casing 132 and also through the coil 134 in the manner as illustrated in FIG. 5 of the drawings. Moreover, the locking head 138 is biased to the locking position, that is the position as illustrated in FIG. 7 of the drawings, by means of a compression spring 144 which is interposed between the locking head 138 and the sleeve 142. The spring 144 biases against the upper end of the locking head 138 and against a shoulder 146 formed on the lower end of the sleeve 142.

The plunger shaft 140 is secured within a recess 148 formed within the locking head 138 by means of a locking pin 150. In addition, the plunger shaft 140 has an upper end 152 extending within the area of the solenoid coil 134. In this way, when the solenoid coil 134 is energized, the upper end 152 will be electromagnetically biased upwardly, and hence the entire plunger 128 is biased upwardly to the unlocked position in the manner as illustrated in FIG. 5. However, when the coil 134 is deenergized, the plunger 128 is spring biased downwardly by means of the spring 144 into the locked position, in the manner as illustrated in FIG. 7. It can be observed that when in the locked position, the locking head 138 extends into the annular space 100 between the two end walls 102 and 104, thereby preventing any shiftable movement of the lock cooperating plug 94.

The housing 90 is also provided with a plurality of bolt-receiving apertures 154 for accommodating bolts in which to lock the lock releasing mechanism A to any convenient portion of the vehicle. These apertures could be designed to accommodate any form of fastener used to secure the lock release mechanism A to the desired portion of the vehicle, as for example a structural wall W, as shown in FIG. 6. In this case, the lock release mechanism A would be located in close proximity to the actual hood release lock in the vehicle.

It can be observed that when a preselected code is introduced into a safety interlock system in proper sequence, the electrical circuitry forming part of the safety interlock system will generate an enabling signal which is introduced into the coil 134 through the lead 136. As this occurs, the coil 134 becomes energized, thereby raising the plunger 128. When the plunger 128 is shifted to the upper position, as illustrated in FIG. 5, the operator of the vehicle can merely pull the handle 34 in the passenger compartment and which is connected to the cable 126. In this way, the lock cooperating plug 94 can be pulled rearwardly, that is to the left, reference being made to FIG. 5. As this occurs, the head 96 will partially block the passage for the plunger 128. Thus, even if the circuit is deenergized, the plunger 128 cannot shift downwardly so that the locking head 138 is introduced into the annular space 100 so long as the handle 34 is pulled to open the lock mechanism.

It can be observed that after the handle is released, and if the circuit is deenergized, the plunger 128 will be biased downwardly through the action of the compression spring 144 and into the annular space 100, thereby preventing further opening movement of the lock release mechanism until a proper code has again been introduced into the vehicle. It is also to be noticed that the hood mechanism or other portion of the vehicle can be closed even though the circuit is deenergized, due to the action of a sensor 162 hereinafter described, without creating any damage to the lock release mechanism, such that the fact that the annular space 100 will always be opened to and in alignment with the locking head 138.

FIG. 4 illustrates the connection of the lock release mechanism A with respect to a conventional lock mechanism 10 used in an automotive vehicle. In this case, it can be observed that the cable 36 extending from one of the camming discs 12 is coupled to the cable 126 by means of a clamp 160. Either one or both of these cables is then extended into the passenger compartment and connected to the hood release handle 34 in the manner as illustrated. Any suitable form of clamp 160 may be employed for this purpose, as for example, a simple hose clamp or the like.

The conductor 136 which is connected to the solenoid coil 134 is also connected to a suitable safety interlock circuit of the type illustrated in FIG. 8 of the drawings. Again, and as indicated above, the conductor 136 would be connected to the preferred type of safety interlock system as defined in the aforesaid patent applications. One of the unique aspects of the present invention is that a sensor 162 operating a switch or otherwise operating as a switch may be located on the hood or other portion of the vehicle which constitutes a closure member. The sensor 162 will sense the position of the hood in order to prevent damage to the lock release mechanism A. Thus, if the ignition is turned off, or otherwise the electrical circuitry forming part of the engine of the vehicle is deenergized, the solenoid 130 will still remain energized until such time as the hood is completely closed. In this way, the plunger will not be bent or otherwise destroyed.

With further consideration to the schematic electrical diagram illustrated in FIG. 8, which more specifically shows a typical form of safety interlock system, this safety interlock system is designed to introduce a proper electrical code in order to generate an enabling signal which, in turn, permits operation of the electrical system of the vehicle and also a release of the hood lock release mechanism. In this case, the electrical safety interlock system comprises a plurality of manually operable push-button switches 164 which are typically mounted on a pad located within the interior of the vehicle, such as the passenger compartment of the vehicle. The manually operable push-button switches 164 are designed to generate an electrical signal when operated in proper sequence and include a hold circuit 166 which is designed to override the system as may be desired.

The push-button switches 164 are connected to a plurality of latches 168 by means of a plurality of inputs into latches 168. The latches 168 are cross-coupled and are preferably comprised of a plurality of NAND-gates so as to create an output signal, such as an enabling signal, when each of the input switches are pressed in proper sequence. When each of the switches 164 are pressed in proper sequence, an enabling signal is generated over an output line 170 which is connected through a resistor 172 into an NPN transistor 174. The emitter of the NPN transistor 174 is connected through a coupling resistor 176 to a terminal 177 of an ignition switch through a diode 178. The diode 178 is grounded through a resistor 180 in the manner as illustrated in FIG. 8.

In addition, the emitter of the transistor 174 is connected through a diode 182 and a resistor 184 to a coil 186 which operates as a solenoid coil of a hood lock release mechanism. In this case, the coil 186 is equivalent to the solenoid coil 134 which will operate the hood lock release mechanism A in accordance with the present invention.

Thus, in accordance with the present invention, it can be observed that the proper introduction of the preselected code in proper orientation of the actuation of the input switches 164 will generate an enabling signal through the transistor 174 which will not only permit operation of the ignition 177, but it will also permit operation of the hood release mechanism. However, when the ignition is deenergized, the hold circuit 166 will permit energization of the coil 186 which operates the hood lock release mechanism by means of the sensor 162 in a conventional manner, and, more specifically, in the manner as illustrated in the copending patent application filed of even date hereof.

The switches 164 which form part of the safety interlock system may be conveniently mounted within a small casing located in a convenient location within the vehicle, as, for example, on the dashboard of the vehicle, as aforesaid. This casing would include a plurality of the manually operable push-button switches 164 which may be operated in proper sequence in order to generate an enabling signal. In addition, light emitting diodes may also be provided on the face plate (not shown) of the small casing to indicate that the switches of the system have been properly operated in sequence in order to permit energization of the vehicle engine and also to permit energization of the solenoid 186 to thereby enable access to the engine compartment of the vehicle.

The hood lock release mechanism of the present invention can be used in conjunction with a wide variety of conventional hood locks on automotive vehicles or other access means to the vehicle, as for example, the trunk lid and like access means. Moreover, the lock release mechanism can be mounted in any suitable location in close proximity to the access means of the vehicle and any form of conventional mounting means may be employed.

It has been found that the lock release mechanism of the present invention is highly reliable and cannot be damaged through inadvertence, and thereby obviates many of the deficiencies of the prior art hood lock release mechanisms.

Thus, there has been illustrated and described a unique lock release mechanism which may be used in conjunction with conventional vehicle locks and in which the mechanism may be operable with a safety interlock system and which meets all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications are deemed to be covered by the invention which is limited only by the following claims.

Having thus described my invention, what I desire to claim and secure by Letters Patent is:

1. An electrically operable lock controlling mechanism and being operable to control a lock device which is capable of locking a closure member movable relative to an access opening when said closure member is in a closed position over said access opening, said lock controlling mechanism comprising:

(a) an outer housing having a first bore and a second bore angularly located with said first bore, (b) a shiftable lock cooperating element located within said first bore, said lock cooperating element having a pair of spaced apart members defining a plunger receiving space capable of being located in alignment with said second bore, (c) a plunger located within said second bore and having a locking section capable of being shifted into a locking position in said plunger receiving space to prevent movement of said element, and capable of being retracted to a non-locking position (d) means biasing said plunger into said locking position, (e) electrically operable means for shifting said plunger to the non-locking position out of said plunger receiving space to permit movement of said lock cooperating element upon energization of said electrically operable means, and (f) sensing means operatively connected to said electrically operable means for holding said plunger in the non-locking position after de-energization of said electrically operable means if said closure member has been moved away from the closed position and until said closure member is returned to the closed position.

2. The lock controlling mechanism of claim 1 further characterized in that said electrically operable means is a solenoid.

3. The lock controlling mechanism of claim 2 further characterized in that said means biasing said plunger is a spring means which normally biases said plunger into the locking position and is overcome and retracted to the non-locking position by energization of said solenoid.

4. The lock controlling mechanism of claim 2 further characterized in that said lock cooperating element is normally biased to a position where said plunger receiving space is aligned with said plunger.

5. The lock controlling mechanism of claim 4 further characterized in that said lock cooperating element is normally biased to a position where said plunger receiving space is aligned with said plunger by a compression spring means.

6. The lock controlling mechanism of claim 5 further characterized in that a cable is connected to said lock cooperating element for manually pulling said plunger against the action of said compression spring means.

7. A lock control system for controlling the action of a conventional lock on a vehicle access means enabling access to a portion of a vehicle, said system comprising:

(a) a safety interlock circuit having a plurality of manually operable switches to generate an operating signal when certain of said switches have been actuated in a proper sequence in accordance with a preestablished code, (b) a plurality of latches forming part of said interlock circuit and operatively connected to said switches and being operable when said switches are operated in the proper sequences, (c) circuit active means forming part of said interlock circuit to cause generation of an enabling signal when the switches are operated in the proper sequence and the latches are operable, (d) a mechanically actuable lock device on a vehicle access means, (e) an electrically operable component forming part of a vehicle engine and being operatively connected to said interlock circuit, said component being operable when said enabling signal is generated and said component not being operable when an enabling signal is not generated, (f) an electrically operable lock release mechanism operatively connected to said interlock circuit and being energized when said enabling signal is generated and permitting opening of said lock device when said lock release mechanism is energized, (g) means operatively associated with said lock release mechanism to prevent opening of said lock device when said lock release mechanism is deenergized, and (h) holding circuit means operatively connected to said latches for overriding the safety interlock circuit to permit energization of said electrically operable component and to permit opening of said lock release mechanism in absence of generation of an enabling signal.

8. The lock control system of claim 7 further characterized in that the lock device is used on an automotive vehicle hood and the access means is an automotive vehicle hood.

9. The lock control system of claim 7 further characterized in that sensing means is operatively connected to said interlock circuit for holding said lock release mechanism in a position as energized even though generation of said enabling signal has ceased until said access means is closed.

10. The lock control system of claim 8 further characterized in that a manually actuable member is located in the passenger compartment of said vehicle and is operatively connected to said lock release mechanism to open same after it has been energized pursuant to said enabling signal.

11. The lock control system of claim 7 further characterized in that said lock release mechanism comprises:

(a) an outer housing having a first bore and a second bore angularly located with said first bore, (b) a shiftable lock cooperating element located within said first bore, said lock cooperating element having a pair of spaced apart members defining a plunger receiving space capable of being located in alignment with said second bore, (c) a plunger located within said second bore and having a locking section capable of being shifted into a locking position in said plunger receiving space to prevent movement of said element, (d) means biasing said plunger into said locking position, and (e) electrically operable means for shifting said plunger out of said plunger receiving space to permit movement of said element upon energization thereof.

12. The lock control mechanism of claim 11 further characterized in that said electrically operable means is a solenoid.

13. The lock control system of claim 12 further characterized in that said means biasing said plunger is a spring means which normally biases said plunger into the locking position and is overcome by energization of the solenoid.

14. The lock control system of claim 12 further characterized in that said lock cooperating element is normally biased to a position where said plunger receiving space is aligned with said plunger.

15. The lock control system of claim 14 further characterized in that said lock cooperating element is normally biased to a position where said plunger receiving space is aligned with said plunger by a compression spring means.

16. The lock control system of claim 15 further characterized in that a cable is connected to said element for manually pulling said plunger against the action of said compression spring means.

17. An electrically operable lock controlling mechanism and being operable to control a lock device, said lock controlling mechanism comprising:

(a) an outer housing having a first bore and a second bore angularly located with respect to said first bore, (b) a shiftable lock cooperating element located within said first bore, said lock cooperating element having a pair of spaced apart members defining a plunger receiving space capable of being located in alignment with said second bore, (c) a plunger located within said second bore and having a locking section capable of being shifted into a locking position in said plunger receiving space to prevent movement of said element, (d) first compression spring means located within said housing and biasing said plunger into said locking position, (e) second compression spring means located within said housing and biasing said lock cooperating element to a position where said plunger receiving space is aligned with said plunger, (f) an electrically operable solenoid for shifting said plunger out of said plunger receiving space to permit movement of said element upon energization thereof, said solenoid capable of overcoming the action of said first compression spring when energized, (g) and a cable operatively connected to said lock cooperating element for manually pulling said plunger against the action of said second compression spring.

18. A lock control system for controlling the action of a conventional lock on a vehicle access means enabling access to a portion of a vehicle, said system comprising:

(a) a safety interlock circuit having a plurality of manually operable switches to generate an enabling signal when certain of said switches have been actuated in a proper sequence in accordance with a preestablished code, (b) a mechanically actuable lock device on a vehicle access means, (c) an electrically operable component forming part of a vehicle engine and being operatively connected to said circuit, said component being operable when said enabling signal is generated, (d) an electrically operable lock release mechanism operatively connected to said interlock circuit and being energized when said enabling signal is generated and permitting opening of said lock device when said lock release mechanism is energized, (e) means operatively associated with said lock release mechanism to prevent opening of said lock device when said lock release mechanism is deenergized, and (f) sensing means operatively connected to said interlock circuit for holding said lock release mechanism is a position as energized even though generation of said enabling signal had ceased until said access means is closed.

19. The lock control system of claim 18 further characterized in that the lock device is used on an automotive vehicle hood and the access means is an automotive vehicle hood.

20. The lock control system of claim 19 further characterized in that a manually actuable member is located in the passenger compartment of said vehicle and is operatively connected to said lock release mechanism to open same after it has been energized pursuant to said enabling signal.

21. The lock control system of claim 18 further characterized in that said lock release mechanism comprises:

(a) an outer housing having a first bore and a second bore angularly located with said first bore, (b) a shiftable lock cooperating element located within said first bore, said lock cooperating element having a pair of spaced apart members defining a plunger receiving space capable of being located in alignment with said second bore, (c) a plunger located within said second bore and having a locking section capable of being shifted into a locking position in said plunger receiving space to prevent movement of said element, (d) means biasing said plunger into said locking position, and (e) electrically operable means for shifting said plunger out of said plunger receiving space to permit movement of said element upon energization thereof.

22. The lock control mechanism of claim 21 further characterized in that said electrically operable means is a solenoid.

23. The lock control system of claim 22 further characterized in that said means biasing said plunger is a spring means which normally biases said plunger into the locking position and is overcome by energization of the solenoid.

24. The lock control system of claim 22 further characterized in that said lock cooperating element is normally biased to a position where said plunger receiving space is aligned with said plunger.

25. The lock control system of claim 24 further characterized in that said lock cooperating element is normally biased to a position where said plunger receiving space is aligned with said plunger by a compression spring means.

26. The lock control system of claim 25 further characterized in that a cable is connected to said element for manually pulling said plunger against the action of said compression spring means.

27. An electrically operable lock controlling mechanism and being operable to control a lock device, said lock controlling mechanism comprising:

(a) an outer housing having a first bore and a second bore angularly located with respect to said first bore, (b) a shiftable lock cooperating element located within said first bore, said lock cooperating element having a pair of spaced apart members defining a plunger receiving space capable of being located in alignment with said second bore, (c) a plunger located within said second bore and having a locking section capable of being shifted into a locking position in said plunger receiving space to prevent movement of said element, (d) first biasing means located within said housing and biasing said plunger into said locking position, (e) second biasing means located within said housing and biasing said lock cooperating element to a position where said plunger receiving space is aligned with said plunger, (f) an electrically operable member for shifting said plunger out of said plunger receiving space to permit movement of said lock cooperating element upon energization thereof, said electrically operable member capable of overcoming the action of said first biasing means when energized, and (g) a cable operatively connected to said lock cooperating element for manually pulling said plunger against the action of said second biasing means.

28. An electrically operable lock controlling mechanism and being operable to control a lock device which is capable of locking a closure member movable relative to an access opening when said closure member is in a closed position over said access opening, said closure member and said vehicle having vehicle lock members which are normally supplied with and relatively permanently mounted on said vehicle and closure member, and where at least one of said cooperating lock members is movable relative to the other to permit engagement and disengagement therebetween, said lock controlling mechanism comprising:

(a) an outer housing having a first bore and a second bore angularly located with respect to said first bore, (b) a shiftable lock cooperating element located within said first bore, said lock cooperating element having a pair of spaced apart members defining a plunger receiving space capable of being located in alignment with said second bore, (c) a plunger located within said second bore and having a locking section capable of being shifted into a locking position in said plunger receiving space to prevent movement of said element and capable of being retracted to a non-locking position, (d) means biasing said plunger into said locking position, (e) means for biasing said lock cooperating element to a position where the plunger receiving space is alligned with said plunger, (f) electrically operable means for shifting said plunger to the non-locking position out of said plunger receiving space to permit movement of said lock cooperating element upon energization of said electrically operable means, and (g) means associated with said shiftable lock cooperating element to permit connection of said shiftable lock cooperating element to one of said vehicle lock members so that the lock controlling mechanism can be used with the normal lock device of the vehicle without removing or bypassing said lock device.

29. The lock controlling mechanism of claim 28 further characterized in that said electrically operable means is a solenoid.

30. The lock controlling mechanism of claim 28 further characterized in that sensing means is operatively connected to said electrically operable means for holding said plunger in the non-locking position after deenergization of said electrically operable means if said closure member has been moved away from the closed position and until said closure member is returned to the closed position.

31. The lock controlling mechanism of claim 29 further characterized in that said means biasing said plunger is a spring means which normally biases said plunger into the locking position and is overcome and retracted to the non-locking position by energization of said solenoid.

32. The lock controlling mechanism of claim 29 further characterized in that said lock cooperating element is normally biased to a position where said plunger receiving space is aligned with said plunger.

33. A lock controlling system for controlling the action of a conventional lock on a vehicle access means enabling access to a portion of a vehicle, said vehicle access means and said vehicle having a vehicle lock members which are normally supplied with and relatively permanently mounted on said vehicle and access means and where at least one of said cooperating lock members is movable relative to the other to permit engagement and disengagement there between, said system comprising:

(a) a safety interlock circuit having a plurality of manually operable switches to generate an enabling signal when certain of said switches have been actuated in a proper sequence in accordance with a pre-established code, said safety interlock circuit also comprising, (1) a plurality of latches operatively connected to said switches and being operable when said switches are operated in the proper sequence, and (2) circuit active means forming part of said interlock circuit to cause generation of said enabling signal when the switches are operated in the proper sequence and the latches are operable, (b) a mechanically actuable lock device on a vehicle access means, (c) an electrically operable component forming part of a vehicle engine and being operatively connected to said interlock circuit, said component being operable when said enabling signal is generated and said component not being operable when an enabling signal is not generated, (d) an electrically operable lock release mechanism operatively connected to said interlock circuit and being energized when said enabling signal is generated and permitting opening of said lock device when said lock release mechanism is energized, (e) means operatively associated with said lock release mechanism to prevent opening of said lock device when said lock release mechanism is deenergized, (f) means associated with said lock release mechanism to permit connection to one of said vehicle lock members so that the lock release mechanism can be used with the normal lock device of the vehicle without removing or bypassing said lock device, and (g) holding circuit means operatively connected to said latches for overriding the safety interlock circuit to permit energization of said electrically operable component and to permit opening of said lock release mechanism in absence of generation of an enabling signal.

34. The lock control system of claim 33 further characterized in that the lock device is used on an automotive vehicle hood and the access means is an automotive vehicle hood.

35. The lock control system of claim 33 further characterized in that sensing means is operatively connected to said interlock circuit for holding said lock release mechanism in a position as energized even though generation of said enabling signal has ceased until said access means is closed.

* * * * *